US005376016A

United States Patent [19]

Inaba et al.

[11] Patent Number: 5,376,016

[45] Date of Patent: Dec. 27, 1994

[54] LOW INSERTING FORCE FITTING MECHANISM FOR ELECTRICAL CONNECTOR

[75] Inventors: Shigemitsu Inaba; Satoshi Yamada, both of Shizuoka, Japan

[73] Assignee: Yazaki Corporation, Tokyo, Japan

[21] Appl. No.: 88,539

[22] Filed: Jul. 9, 1993

[30] Foreign Application Priority Data

Jul. 10, 1992 [JP] Japan ..... 4-183464

[51] Int. Cl.[5] ..... H01R 13/627

[52] U.S. Cl. ..... 439/364; 439/357

[58] Field of Search ..... 439/359, 360, 361, 362, 439/363, 364, 370, 372, 411, 412

[56] References Cited

U.S. PATENT DOCUMENTS

| | | | |
|---|---|---|---|
| 3,159,444 | 12/1964 | Stine, Jr. | 439/359 |
| 3,853,381 | 12/1974 | Morningstar | 439/364 |
| 4,627,759 | 12/1986 | Kato et al. | 403/2 |
| 4,645,282 | 2/1987 | Frear | 439/364 |
| 4,684,190 | 8/1987 | Clark et al. | 439/364 |

FOREIGN PATENT DOCUMENTS

| | | | |
|---|---|---|---|
| 2319005 | 10/1974 | Germany | 439/359 |
| 52-133993 | 10/1977 | Japan . | |
| 410977 | 1/1992 | Japan . | |

*Primary Examiner*—Gary F. Paumen
*Assistant Examiner*—Hien D. Vu
*Attorney, Agent, or Firm*—Sughrue, Mion, Zinn, Macpeak & Seas

[57] ABSTRACT

A connector which includes a male connector housing (1), a female connector housing (2), and a rotary shaft (3) for camming the male connector housing (1) into engagement with the female connector housing. The male connector housing 1 includes flexible arms (6) having engagement claws (8) for alternatively engaging holes (19) and (20) provided in the female connector housing so as to retain the connector housings in a provisionally engaged position or a completely engaged position. The flexible arms also include a constrictive portion (7) for flexing the arms outwardly when the shaft is inserted into the connector housings. As a result, the engagement claws (8) are disengaged from the provisional engagement holes (19) so that the connector housings can be moved to the completely engaged position. After the connector housings have been moved to the completely engaged position as a result of rotation of the shaft, the shaft can than be removed from the connector housings so that the claws (8) engage holes (20).

6 Claims, 4 Drawing Sheets

LOW INSERTING FORCE FITTING MECHANISM FOR ELECTRICAL CONNECTOR

BACKGROUND OF THE INVENTION

1. Field of the invention

The present invention relates to a mechanism for fitting multi-terminal electrical connectors to each other with a low inserting force through the use of a rotary shaft which is pushed into the connectors and pulled out therefrom.

2. Prior art

FIG. 7 shows a conventional mechanism which was disclosed in the Unexamined Japanese Utility Model Application Hei. 4-10977 and is for fitting the male connector 26 and female connector 31 of a multi-terminal electrical connector to each other by a low inserting force. The mechanism includes a rotary shaft 28 having a spiral cam groove 27 and a handle 33 conjoined to the body of the shaft, a securing pin 29, a washer 30, and an engagement projection 32 provided in the female connector 31 so as to be engaged in the groove. To fit the connectors 26 and 31 to each other, the rotary shaft 28 is rotatably put into the male connector and rotatably supported with the pin 29 and the washer 30, and the handle 33 is then turned.

Another conventional mechanism which was disclosed the Unexamined Japanese Utility Model Application Sho. 60-875 and is for fitting the male connector and female connector to each other includes a bolt extending through one of the connectors, and a nut secured to the other of the connectors. To fit the connectors to each other, the bolt is engaged in the nut.

FIG. 8 shows yet another conventional mechanism which was disclosed in the Unexamined Japanese Utility Model Application Sho 52-133993 and is for fitting the male connector 34 and female connector 36 of an electrical connector to each other. The mechanism includes none of a rotary shaft and a bolt, but includes a lever 35 provided on the side of the male connector 34, and an engagement pin 37 provided on the female connector 36. To fit the connectors 34 and 36 to each other, the lever 35 is engaged with the pin 37 to apply a leverage action to the connectors.

However, as for each of the conventional mechanisms, the low-force fitting means such as the rotary shaft 28, the bolt and the lever 35 is integrally provided with the electrical connector. For that reason, the size and weight of the connector are increased. This is a problem.

SUMMARY OF THE INVENTION

In view of the forgoing problem, it is an object of the invention to provide a mechanism which is for fitting the electrical connectors to each other by a low inserting force and is not such as to increase the size and weight of the connector after the fitting.

An aspect of the present invention, there is provided a low inserting force fitting mechanism for electric connector comprising: one connector having a shaft hole, one connector including: a pair of flexible engagement arms having a pair of engagement claws and a pair of constrictive portions, constrictive portions forms a distance which is smaller than a diameter of shaft hole, engagement claw and constrictive portion are located in turn from an end portion of shaft hole toward an insertion direction of connectors; a pair of extract prevention projections located in orthogonal to flexible engagement arms; the other connector including temporary engagement portions and real engagement portions which are corresponded to engagement claws, and screw engagement projections provided in an inner peripheral portion of shaft hole; and a rotary shaft including screw thread portions provide in turn which screw threads and a communication notch portion which are corresponded to screw engagement projections, an annular portion having communication grooves corresponding to extract prevention projections, and an annular groove subsequently engaged with the extract prevention projections and constrictive portion.

To fit the electrical connectors to each other by the low inserting force through the use of the mechanism provided in accordance with the present invention, the rotary shaft is inserted into the shaft hole under the condition that engagement claws of the engagement portion is engaged with the temporary engagement portion. The rotary shaft pushes the constrictive portion to expand the constrictive portion so as to disengage an engagement between the engagement claws and the temporary engagement portion. Thus, the extract preventive projections is engaged with an annular groove of the rotary shaft so that screw threads are engaged with screw engagement projections of the other connector. The rotary shaft is thereafter turned so that the other connector is attracted toward each other to be fitted to each other. After that, the rotary shaft is pulled out from the connectors with the communication notch portion being communicated with the screw engagement portion and the communication groove being communicated with the extract preventive projections. At that time, the engagement portion of the flexible engagement arm is engaged with the real engagement portion to lock the connectors to each other.

BRIEF DESCRIPTION OF THE DRAWINGS

FIG. 4(*b*) is a longitudinally sectional view of the mechanism along lines A shown in FIG. 4(*a*);

FIG. 5(*b*) is a longitudinally sectional view of the mechanism along lines B shown in FIG. 5(*a*).

DETAILED DESCRIPTION OF THE PREFERRED EMBODIMENTS

An embodiment of the present invention is hereafter described with reference to the drawings attached hereto.

Figure 1:
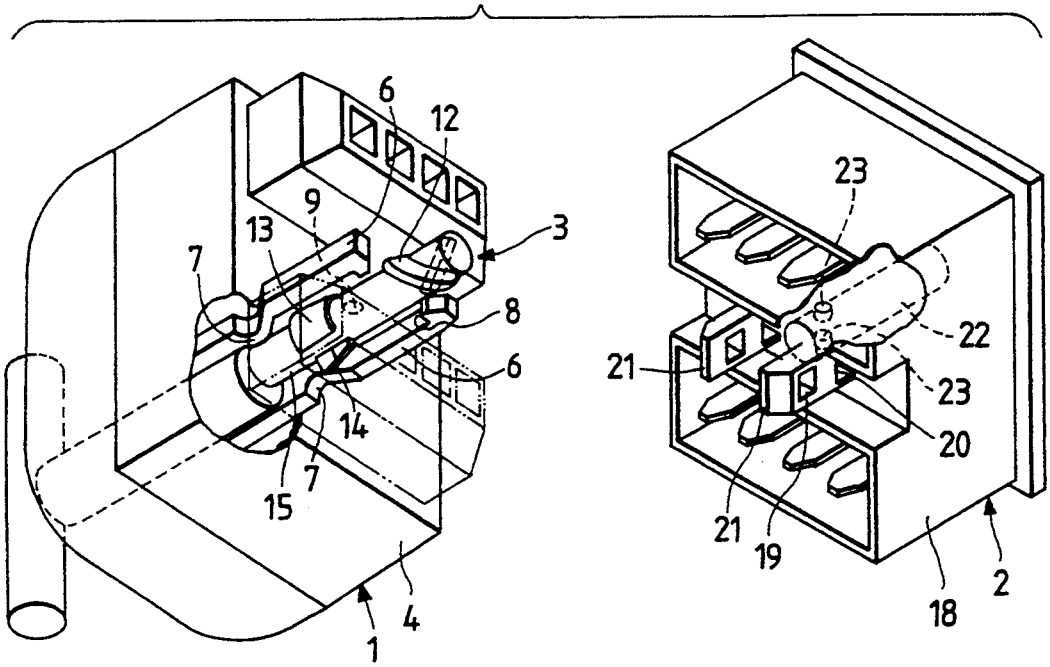
FIG. 1 is an exploded perspective view of a mechanism of an embodiment of the present invention.
Figure 2:
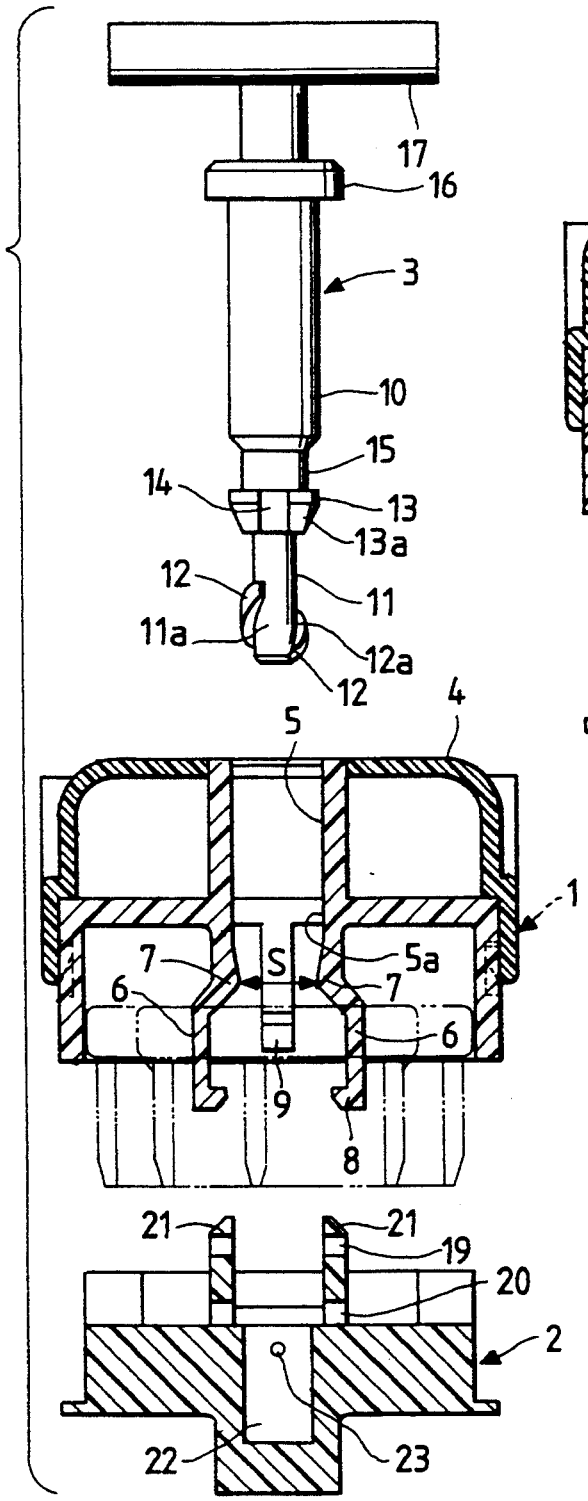
FIG. 2 is a longitudinally-sectional exploded view of the mechanism of the present invention.

FIG. 1 is an exploded perspective view of a mechanism for fitting a male connector 1 and a female connector 2 to each other with a low inserting force. FIG. 2 is a longitudinally-sectional exploded view of the mechanism. As shown in FIGS. 1 and 2, the mechanism is constituted by the male connector 1, the female connector 2, and a rotary shaft 3 made of a metal and capable of being removably fitted in the male connector 1.

The male connector 1 includes a male connector housing 4 made of a resin and a pair of right and left flexible engagement arms 6 at the central portion of the male connector housing 4. A shaft hole 5 is provided in the male connector housing and extends in the direction in which the male and female connectors 1 and 2 are fitted together. The flexible connector arms 6 extend from the male connector housing in the fitted direction. The connector arms includes a constrictive portions 7 which are separated by a distance which is smaller than the diameter of the shaft hole 5, and engagement claws 8 provided at distal ends of the flexible connector arms 6 and extending inwardly toward each other. The male connector 1 also includes a pair of extract prevention projections 9 mounted between the pair of the constrictive portions 7 and the pair of the engagement claws 8 in such a manner that a line defined by joining the pair of the flexible connector arms 6 is orthogonal to a line defined by joining the pair of extract prevention projections 9.

The rotary shaft 3 is inserted into the shaft hole 5 in order to fit the male and female connectors 1 and 2 to each other. The rotary shaft includes: an intermediate tubular portion 10 having a diameter which is substantially the same as the diameter of the shaft hole 5; a small tubular portion 11 extending from a distal end of the intermediate tubular portion 10; a pair of screw threads 12 having screw engagement slope 12*a*, respectively; a pair of communication notch portions 11*a* provided between the pair of screw threads 12 an annular portion 13 having a tapered surface 13*a*; a pair of communication grooves 14 extending from the communication notch portions 11*a* in an axial direction of the annular portion 13; an annular groove 15, which is communicated with the communication grooves 14, provided at the intermediate tubular portion 10 in vicinity of the annular portion 13; a large tubular portion 16 provided at a proximal end of the intermediate portion 10; and a handle 17 jointed to the large tubular portion 16 at the upper end thereof.

The communication notch portion 11*a* and the communication groove 14 are designed to pass through the extract prevention projection 9 of the connector housing 4 of the male connector 1. The annular groove 15 is designed to separately engage the extract prevention projection 9 and the constrictive portions 7 of the flexible engagement arms 6.

On the other hand, a female connector housing 18 includes a pair of engagement bars 21, which confront each other, and which extend in the direction in which the connectors 1 and 2 are fitted to each other. Each engagement bar 21 is provided with a temporary engagement hole 19 and a real engagement hole 20 in such a manner that the temporary engagement hole and the real engagement hole are subsequently engaged with the engagement claws 8 of the flexible engagement arms 6. The connector housing 18 further includes a pair of screw engagement projections 23 provided in an inner peripheral portion of an insertion hole 22 so as to engaged with the screw threads 12 of the rotary shaft.

As shown in FIGS. 3 to 6, fitting condition of the male and female connector 1 and 2 will now be described hereinafter.

Figure 3:
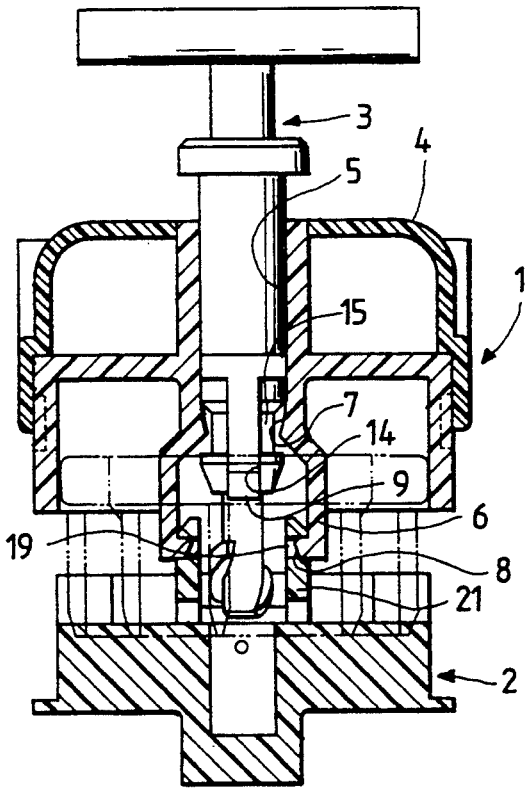
FIG. 3 is a longitudinally sectional view of the mechanism to illustrate the state that the components are tentatively engaged with each other.

In FIG. 3, the rotary shaft 3 is inserted into the shaft hole 5 under the condition that the male and female connectors 1 and 2 are in a temporary engagement condition. Thereafter, the extract prevention projections 9 of the male connector housing 4 are positioned into communication groove 14 and the constrictive portions 7 of the flexible arms 6 are engaged with the annular groove 15. The engagement claws 8 of the flexible engagement arms 6 are engaged with the temporary engagement holes 19 of the engagement bars 21 so as to adjust the relative position of the male and female connectors 1 and 2.

Figure 4A:
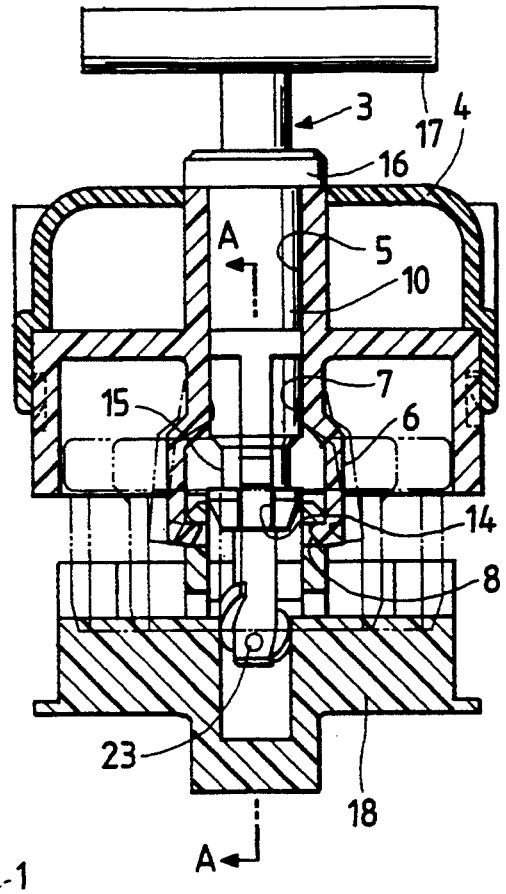
FIG. 4(*a*) is a longitudinally sectional view of the mechanism to illustrate the state that the rotary shaft of the mechanism is pushed into the components.
Figure 4B:
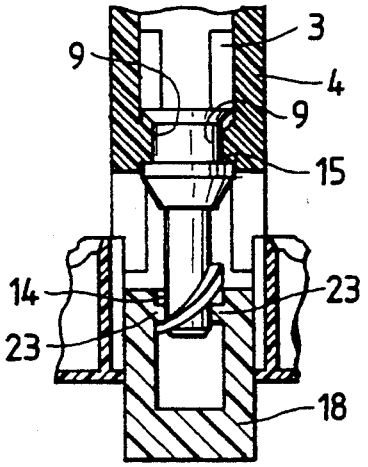
Figure 5A:
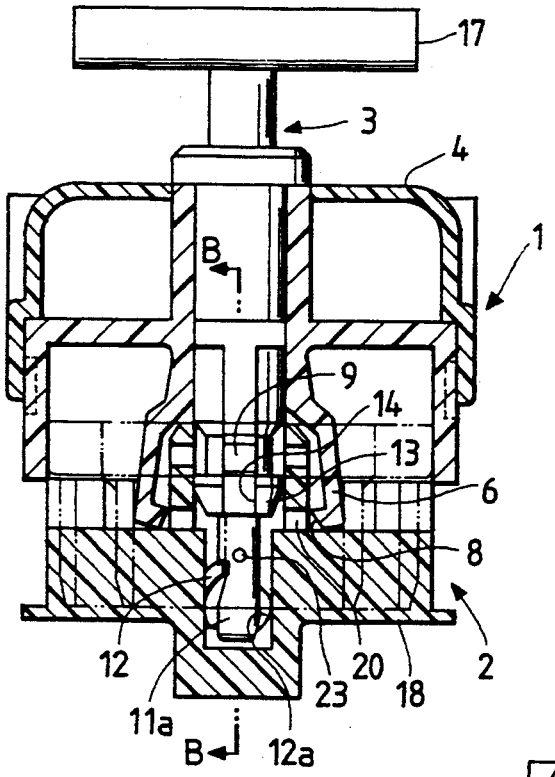
FIG. 5(*a*) is a longitudinally sectional view of the mechanism to illustrate the state that the components are fitted to each other.
Figure 6:
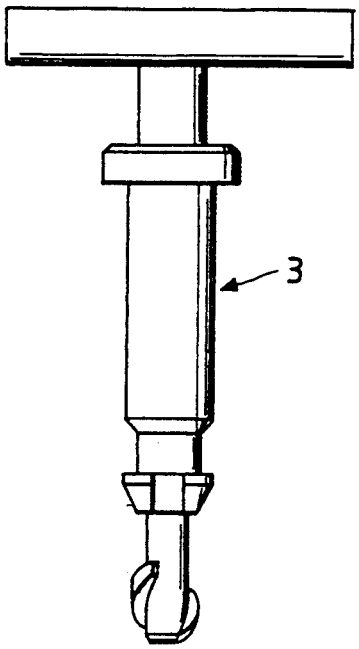
FIG. 6 is a longitudinally sectional view of the mechanism to illustrate the state that the rotary shaft is pulled out from the components.
Figure 5B:
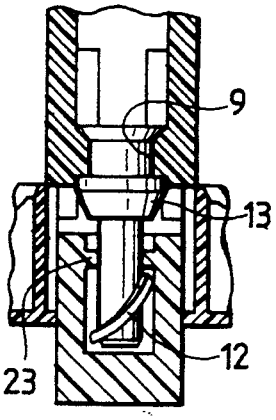
Figure 5B:
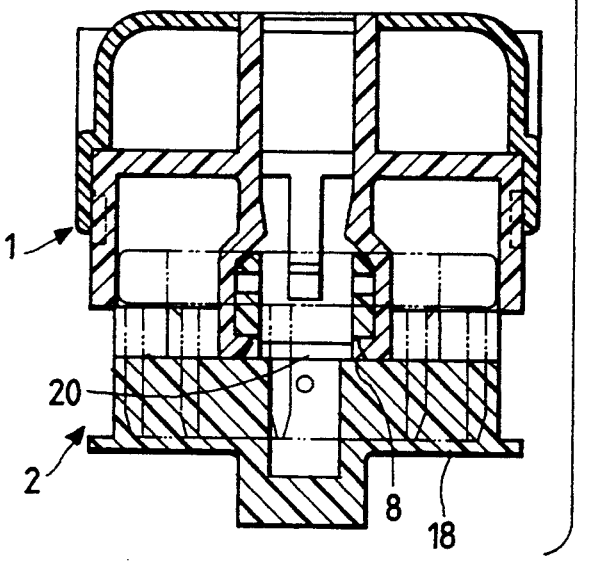
Figure 7:
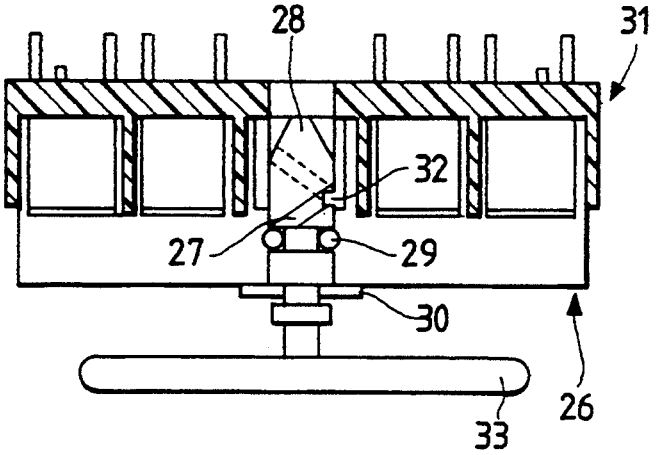
FIG. 7 PRIOR ART
FIG. 7 is a longitudinally sectional view of a conventional mechanism for fitting the components of an electrical connector to each other.
Figure 8:
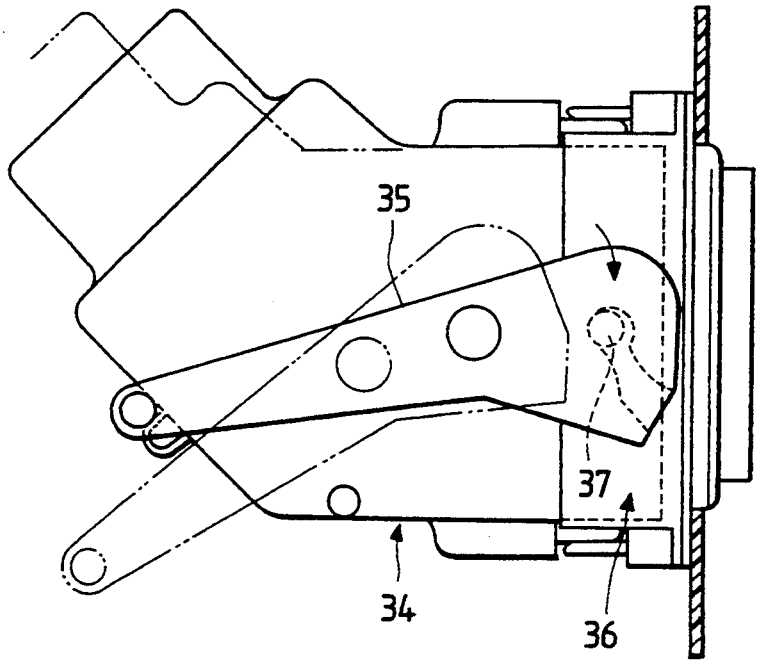
FIG. 8 PRIOR ART
FIG. 8 is a side view of another conventional mechanism for fitting the components of an electrical connector to each other.

Next, as shown in FIG. 4(*a*), the rotary shaft 3 is pushed to contact the large tubular portion 16 with an outer end of the shaft hole 5 of the male connector housing 4 so that intermediate tubular portion 10 of the rotary shaft expands the constrictive portions 7 so as to disengage the temporary engagement between the engagement claws 8 and the temporary engagement holes 19. As shown in FIG. 4(*b*), the extract prevention projections 9 of the male connector housing 4 are engaged with the annular groove 15 of the rotary shaft 3 to secure the rotary shaft 3 in the axis direction thereof. Thus, the screw engagement projections 23 of the male connector housing are positioned in the communication groove of the rotary shaft 3.

After that, the rotary shaft 3 is rotated a half turn with the handle 17 so that the screw engagement projections 23 are cammed along the engagement slops 12*a* to engage the male and female connector 1 and 2 each other. At the same time, the screw engagement projections 23 are positioned on the communication notch portions 11*a* of the screw threads 12 and the extract prevention projections 9 of the male connector housing 4 are located in the communication grooves 14 of the annular portion 13. Moreover, the engagement claws 8 are positioned adjacent the real engagement hole 20 of the male connector housing 18 and confronted with each other under the condition that the flexible engagement arms 6 of the male connector housing are expanded outwardly.

Finally, the rotary shaft 3 is removed from the male and female connectors 1 and 2 so that the engagement claws 8 are engaged with the real engagement holes 20 of the female connector housing 18 to lock the connectors 1 and 2 to each other. To separate the male and female connectors 1 and 2 from each other, the rotary shaft is inserted into the connectors and rotated in the reverse direction from that described above.

Since the rotary shaft of a mechanism provided in accordance with the present invention in order to fit electrical connectors to each other can be easily pulled out from the connectors after the fitting thereof, it is avoided to increase the size and weight of the connector. Since the complete fitting of the connectors is confirmed by pulling out the rotary shaft therefrom, it is prevented to leave the connector incompletely fitted to each other.

What is claimed is:

1. A low insertion force connector comprising:

a pair of electrical connector housings each having a terminal which are adapted to be connected together by moving one of said connector housings toward another of said connector housings in an insertion direction, said one connector housing having a shaft hole and including:

a pair of flexible engagement arms extending in said insertion direction, each of said engagement arms including an engagement claw and a constrictive portion, said constrictive portions being separated by a distance which is smaller than a diameter of said shaft hole, said engagement claw and said constrictive portion being sequentially located in said insertion direction;

said other connector housing including a temporary engagement member and a real engagement member which are engageable by said engagement claws, and engagement projections provided in an inner peripheral portion which is aligned with said shaft hole;

a rotary shaft including engagement threads and an annular member having a taper portion; and extracting prevention means for preventing said one connector from being disconnected from said rotary shaft, wherein said extracting prevention means includes:

a pair of extract prevention projections located orthogonally to said flexible engagement arms;

communication grooves corresponding to said extract prevention projections, said communication grooves being provided in said annular member; and an annular groove subsequently engaged with said extract prevention projections and constrictive portion, said annular groove being provided in said rotary shaft.

2. A low insertion force connector as claimed in claim 1, wherein said temporary engagement member includes one of a projection and a groove and said real engagement member includes one of a projection and a groove.

3. A low insertion force connector as claimed in claim 1, wherein said rotary shaft is detachably connected to said connector housings.

4. A low insertion force connector as claimed in claim 1, wherein said engagement threads are engaged with said engagement projections.

5. A connector, comprising:

a pair of electrical connector housings each having a terminal adapted to be connected to each other, one of said connector housings having a bore extending therethrough and including a pair of flexible engagement arms extending toward another of said connector housings, each of said engagement arms including an engagement claw for securing said one connector housing to the other connector housing in a provisionally engaged position at which said connector housings are partially engaged and a completely engaged position at which said connector housings are completely engaged with each other, said other connector housing including a cam projection;

a shaft adapted to be inserted into said bore of said one connector housing;

cam means provided on said shaft and engageable with said cam projection of said other connector housing for camming said connector housings towards each other in response to rotation of said shaft so as to move said connector housings from said provisionally engaged position to said completely engaged position; and disengaging means, responsive to said rotation of said shaft, for disengaging said engagement claw of each of said engagement arms from said other connector housing when said connector housings are moved from said provisionally engaged position to said completely engaged position.

6. The connector of claim 5, wherein said shaft is removable from said connector housing and wherein when said shaft is removed, said engagement claws remain engaged with said other connector housing in said completely engaged position.

* * * * *